United States Patent [19]

Leung et al.

[11] Patent Number: 4,559,477

[45] Date of Patent: Dec. 17, 1985

[54] THREE CHAMBER NEGATIVE ION SOURCE

[75] Inventors: Ka-Ngo Leung, Hercules; Kenneth W. Ehlers, Alamo; John R. Hiskes, Livermore, all of Calif.

[73] Assignee: The United States of America as represented by the United States Department of Energy, Washington, D.C.

[21] Appl. No.: 550,701

[22] Filed: Nov. 10, 1983

[51] Int. Cl.[4] ..... H01J 27/02

[52] U.S. Cl. ..... 315/111.81; 315/111.91; 315/111.31; 315/111.41; 313/362.1; 313/363.1; 250/424; 250/427

[58] Field of Search ..... 315/111.81, 111.91, 315/111.31, 111.41; 250/424, 427; 313/360.1, 361.1, 362.1, 363.1

[56] References Cited

U.S. PATENT DOCUMENTS

| | | | |
|---|---|---|---|
| 4,140,943 | 2/1979 | Ehlers | 315/111.41 |
| 4,377,773 | 3/1983 | Hershcovitch et al. | 315/111.81 |
| 4,407,705 | 10/1983 | Garscadden et al. | 204/157.1 H |
| 4,447,732 | 5/1984 | Leung et al. | 315/111.81 X |
| 4,486,665 | 12/1984 | Leung et al. | 250/427 |

OTHER PUBLICATIONS

Ehlers et al., "Multicusp Negative Ion Source", *Rev. Sci. Instrum.*, vol. 51, No. 6, Jun. 1980, pp. 721–727.

Ehlers et al., "Electron Suppression in a Multicusp Negative Ion Source", *Appl. Phys. Lett.*, vol. 38, No. 4, Feb. 1981, pp. 287–289.

Leung et al., "H⁻ Ion Formation from a Surface Conversion Type Ion Source", *J. Appl. Phys.*, vol. 52, No. 6, Jun. 1981, pp. 3905–3911.

Leung et al., "Self Extraction Negative Ion Source", *Rev. Sci. Instrum.*, vol. 53, No. 6, Jun. 1982, pp. 30–36.

Leung et al., "Extraction of Volume-Produced H⁻ Ions from a Multicusp Source", Lawrence Berkeley Lab, University of California preprint, Aug. 1982.

*Primary Examiner*—David K. Moore
*Assistant Examiner*—Vincent DeLuca
*Attorney, Agent, or Firm*—L. E. Carnahan; Roger S. Gaither; Judson R. Hightower

[57] ABSTRACT

A negative ion vessel is divided into an excitation chamber, a negative ionization chamber and an extraction chamber by two magnetic filters. Input means introduces neutral molecules into a first chamber where a first electron discharge means vibrationally excites the molecules which migrate to a second chamber. In the second chamber a second electron discharge means ionizes the molecules, producing negative ions which are extracted into or by a third chamber. A first magnetic filter prevents high energy electrons from entering the negative ionization chamber from the excitation chamber. A second magnetic filter prevents high energy electrons from entering the extraction chamber from the negative ionizing chamber. An extraction grid at the end of the negative ion vessel attracts negative ions into the third chamber and accelerates them. Another grid, located adjacent to the extraction grid, carries a small positive voltage in order to inhibit positive ions from migrating into the extraction chamber and contour the plasma potential. Additional electrons can be suppressed from the output flux using ExB forces provided by magnetic field means and the extractor grid electric potential.

20 Claims, 11 Drawing Figures

THREE CHAMBER NEGATIVE ION SOURCE

BACKGROUND OF THE INVENTION

The United States Government has rights in this invention pursuant to Contract No. W-7405-ENG-48 between the U.S. Department of Energy and the University of California, for the operation of Lawrence Livermore National Laboratory.

This invention relates to ion sources and, more particularly, to negative ion sources having large volume tandem chambers in which neutral molecules are vibrationally excited and ionized and the resulting negative ions extracted. This invention further relates to the production of negative ions for use in generating neutral beams for magnetic confinement plasma devices.

Magnetic confinement fusion devices, such as tokamaks and magnetic mirror machines, require a source of energetic particles to maintain the magnetically trapped ion population. High energy neutral beams provide these particles through a process that also heats or adds energy to the confined plasma. Because neutral particles are not affected by strong magnetic fields, the particles will penetrate into the plasma without being deflected by confining magnetic fields.

Ion sources are a basic component of the neutral beam systems for magnetic fusion energy or magnetic confinement plasma devices. Ions from an ion source are electrostatically accelerated to high energies and subsequently neutralized in order to provide a beam of high energy, neutral atoms. The high energy neutral atoms are injected into magnetic confinement plasma devices where they are ionized by the target plasma and magnetically confined as high energy ions. The high energy ions deposited in this manner in the magnetic confinement plasma device provide both fuel for fusion reactions and heat by energy transfer through particle interactions.

Positive ion-based neutral beam systems are used extensively in fusion energy and plasma confinement applications because positive ions are relatively easy to generate using electron discharges. An example of a source for producing positively charged hydrogen ions is shown in U.S. Pat. No. 4,140,943, granted Feb. 20, 1979 Kenneth W. Ehlers. Hydrogen or deuterium are introduced into a plasma generation vessel and ionized by a high current electron discharge. The ions in the resulting plasma are then accelerated through an electrostatic potential gradient to a desired energy level. The vessel has an extractor grid whose potential is negative with respect to the plasma in order to suppress electrons in the output flux by electrostatic repulsion. To convert the positive ions to high energy neutral atoms, the positive ions from the ion source are passed through a low pressure gas cell, containing a gas such as $D_2$, where charge exchange neutralization takes place. For example, a positive deuterium ion beam having particle energies of 20 to 150 KeV can be converted to a neutral atom beam by passing the beam through a gas cell having about $10^{15}$ molecules/cm$^2$.

There are, however, two major problems to using positive ion-based neutral beams for future fusion energy or plasma confinement applications. One problem is that at increased accelerating potentials for the positive ions, it is increasingly more difficult to neutralize the positive ions. It is more difficult to attach an electron at higher accelerating potentials or velocities. Therefore, as higher energy ions for higher energy neutral beams are required, greater percentages of the ionized particles cannot be converted to neutral particles.

Un-neutralized positive ions are diverted from entering the target plasma by the surrounding (confinement) magnetic fields making no contribution to fueling or increasing the plasma energy. As ion acceleration energies increase, positive ion sources deposite fewer high energy particles in the plasma. Fewer high energy particles means less heating or fuel for the plasma. In addition, some deflected ions must be collected on "ion dumps".

This decrease in efficiency manifests itself in an increase of energy required, to accelerate additional ions to compensate for the decrease in neutralized particles reaching the plasma, and to operate the ion dumps. Typical neutral beam systems will be operating at energy consumption levels of many megawatts and any decrease in efficiency is a significant energy loss. The economic feasibility of fusion reactor, as with any utility power source, hinges on the critical amount of power input required to achieve a given power output.

Present neutral beam systems operate in the range of 20 to 150 keV. Future fusion reactors and plasma devices will require beam energies on the order of 200 to 400 keV with densities over 40 mA/cm$^2$. Therefore, the above-described limitations of positive ion based neutral beams will be increasingly costly in terms of energy loss.

The second problem encountered in positive ion-based neutral beams is the production of neutral atoms having less than the full energy imparted by electrostatic acceleration potentials. The positive ions produced can consist of atomic, di-atomic and tri-atomic ions. Such a mixture of ions after neutralization and separation into atomic species creates a spectrum of full, half and one-third energy neutral atoms in the system output beam (from conservation of energy). This decreases the efficiency of energy transfer to the plasma by providing atoms having insufficient energy for heating the plasma.

Since future fusion energy devices and reactors require more energy and particles input to maintain sustained operation in larger volumes, higher and higher energy neutral beam systems are being considered. Due to the previously described problems, the use of negative ions, rather than positive ions, in neutral beam systems is an attractive alternative because neutralization of negative ions is considerably more efficient for higher ion energies. In the case of negative hydrogen or deuterium ions, an electron is attached to the neutral atom by a weak 0.7 eV bond so that neutralization by detachment is relatively easy to accomplish.

Gas cells similar to those used for positive ion sources can operate at efficiencies above 50 percent for negative hydrogen and deuterium ions having energies around 200 keV, and projected efficiencies as high as 99 percent are predicted for electron photodetachment cells using lasers.

However, present high current sources of negative ions have several problems, the first being low current density on the order of less tha $10^{11}$ ions/cm$^2$ or low current output of only a few mA/cm$^2$. The second problem is the production of considerable numbers of undesired electrons along with the negative ions extracted and a considerable amount of energy or power wasted in accelerating these electrons. The high energy electrons also produce significant amounts of undesired X-rays which requires shielding or environmental controls.

Some of the electrons can be separated from a negative hydrogen ion beam by using applied ExB forces from an electron deflector which diverts them to collector electrodes. Creation and interception of large numbers of electrons from the output of a negative ion source, however, exacts a high price in terms of energy consumption. A considerable amount of power is required to keep collector electrodes maintained at a particular potential, and at stable temperature, in the face of a large current of collected high energy electrons. The acceleration system for the negative ions also expends energy in accelerating electrons before they are diverted, energy that is not contributed to the ions nor deposited in the target plasma. In addition, any electrons accelerated with the negative ions and not removed are diverted by magnetic fields of the plasma or fusion device and can ionize other particles, thus creating low energy ions or impurities that can drift into electrostatic thermal barriers and cause problems. Therefore, it is desirable that as many electrons as possible be suppressed from the output flux of a high current, negative ion source.

One approach for the production of negative hydrogen ions is disclosed in a paper entitled "A Self-Extraction Negative Ion Source," presented in *Review of Scientific Instrumentation* 53, June 1982, page 803, by Leung and Ehlers. The technique uses surface formation processes on a low work function molybdenum converter. Positive hydrogen ions created in a plasma discharge are accelerated through a positive potential to strike a molybdenum converter surface. Negative ions are formed at the converter surface and accelerated away by the same positive potential. However, electrons accompany the negative ions in a ratio of 8 electrons to 1 ion, which is unacceptable for fusion applications. In order to reduce this effect, a potential bearing grid or wire was used to reduce the ratio to 0.12 electrons to 1 ion. Also, cesium gas is mixed with the hydrogen ions before acceleration to further reduce the number of electrons present.

Other negative ion sources also employ cesium in producing negative ions. Cesium gas cells are used to convert positive ions traversing the cell into negative ions through the process of double electron capture. Alternatively, a liquid cesium converter can be bombarded with positive ions as in the above surface technique. However, cesium is a very active, hazardous substance requiring processing and handling apparatus and cooling for targets. Some of the cesium and base materials are sputtered from the surface of converters, or deflected from gas streams, contaminating the neutral beam and wasting energy.

Another approach is disclosed in the co-pending application, Ser. No. 405,963, entitled "A Negative Ion Source," by K. W. Ehlers and Ka-Ngo Leung, DOE patent case number S-58,174, RL-8671. There, two tandem chambers are used to first ionize a hydrogen gas into negative ions and then extract negative ions for acceleration. This has the limitation that the density of negative ions tends to be low.

Increasing the ion population means increasing the high energy electron population which also detaches electrons from both ions and from neutrals creating fewer negative ions and several positive ions. The positive ions are attracted to the extraction grids and tend to drag low energy electrons across magnetic fields to the grids and beam output. Decreasing the population, of course, decreases the negative ion density and current, although electron output is improved. A suppression grid is used to help balance these effects to obtain an improved negative ion beam output over previous devices. However, what is needed is a method or apparatus that suppresses the creation of positive ions and allows a higher density or current of negative ions at the extraction grids with greater efficiency.

SUMMARY OF THE INVENTION

It is an object of this invention to provide a negative ion source which efficiently provides a large flux of negatively ionized particles.

It is another object of this invention to provide a volume source of negative ions which has a current density sufficient for magnetic fusion applications.

It is yet another object of this invention to provide a volume source of negative ions which has free electrons suppressed from the output.

It is still another object of this invention to provide a volume source of negative ions which can be efficiently accelerated to energies in excess of 150 keV.

It is still another object of this invention to provide a volume source of negative ions which can be electrostatically accelerated to high energies and subsequently neutralized to form a high energy neutral beam for use with a magnetically confined plasma.

To achieve the foregoing and other objects of the invention and in accordance with the purpose of the present invention, as embodied and broadly described herein, a method and apparatus are disclosed for providing a negative ion source. The invention is particularly useful for generating large volumes of negative ions which are electrostatically accelerated to high energies and subsequently neutralized to form a high energy neutral beam which is then used to heat a magnetically confined plasma.

The apparatus according to the invention is a source of negative ions generated from neutral molecules. The source comprises a vessel having two magnetic filters for reflecting high-energy electrons extending across the vessel and dividing it into three chambers. The ion source has at least one input port for injecting neutral molecules into the first chamber. The first chamber, called the excitation chamber, is equipped with an electron source or discharge means for creating a population of high energy electrons which interact with the molecules so as to increase the molecular vibrational energy level. The first magnetic filter acts as an interface for the first and second chambers and acts to prevent high energy electrons from entering the second chamber with excited molecules.

The second chamber, called the negative ionization chamber, has a second electron source or discharge means for creating low energy, thermal, electrons that interact with the vibrationally excited molecules, from the first chamber, to dissociate the molecules into negative ions. The second magnetic filter acts as an interface for the second and third chambers and prevents high energy electrons from entering the third chamber.

The third chamber, called the extraction chamber, has a positively-biased extractor grid located across the chamber from the magnetic filter for extracting a flow of negative ions from the negative ionization chamber. A plasma grid is located adjacent to the extractor grid interior to the third chamber and is biased slightly positive with respect to the plasma potential in the negative ionization chamber to maintain a constant plasma potential between the second and third chambers.

In one embodiment of the invention, both magnetic filters are provided by an array of permanent magnets disposed across the vessel with north and south poles of adjacent magnets facing each other. This produces a fairly uniform magnetic field substantially perpendicular to the trajectory of particles traversing between any two chambers.

Further aspects of the invention include additional means for suppressing electrons in the form of a magnetic field across the output of the extractor chamber, aligned with respect to the electric field of the extractor to provide EXB drift to any electrons.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the invention and, together with the description, serve to explain the principles of the invention. In the drawings:

FIG. 9(*b*) is a view as in FIG. 9(*a*) showing an alternative plasma grid element.

DETAILED DESCRIPTION OF THE PREFERRED EMBODIMENT

Reference is now made in detail to a preferred embodiment for practicing the method and apparatus of the invention, preferred embodiments of which are illustrated in the accompanying drawings.

Figure 1:
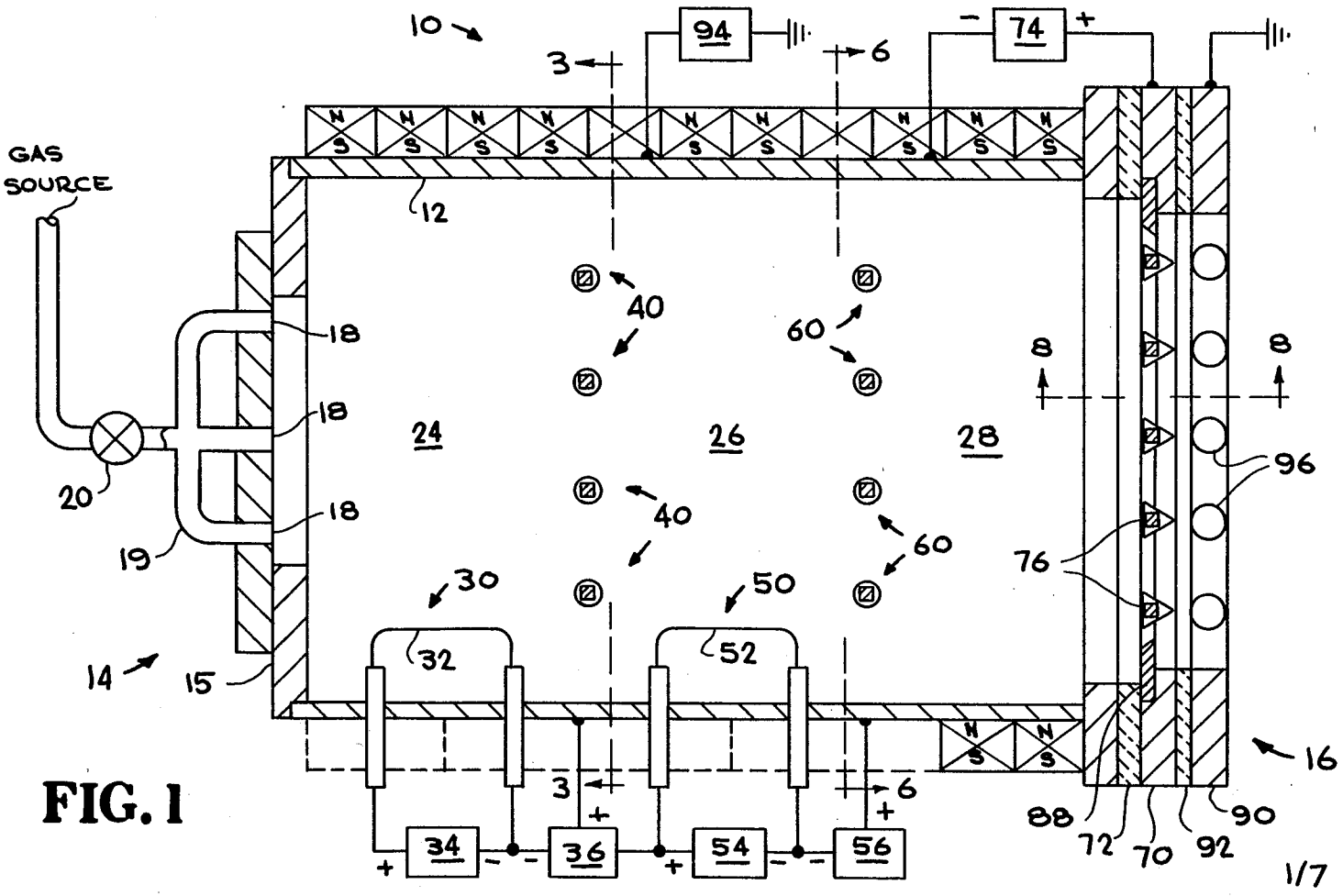
FIG. 1 is a schematic view of an ion source according to the invention.

Referring to FIG. 1, an embodiment of a negative ion source 10 is shown housed in a vessel 12. Vessel 12 can have a circular, rectangular or other cross-section depending on specific applications and associated hardware with which it must interface. The preferred embodiment, illustrated and discussed hereafter in detail, is a cylindrical vessel 12 having end walls 14 and 16. The interior of vessel 12 is evacuated and maintained at a low pressure on the order of $10^{-3}$ Torr. It is necessary to remove air and other impurities that would contaminate the negative ion source. This is accomplished by commercially available vacuum pumping apparatus (not shown) or through connection of ion source 10 to a low pressure plasma confinement device. The overall dimensions of vessel 12 are predetermined from an analysis of the mean free path for particle interactions to be discussed below.

End wall 14 of vessel 12 consists of a circular plate 15 attached to vessel 12 with a fluid-tight seal. Plate 15 can be secured to vessel 12 by bolts passing through the plate into threaded recesses in vessel 12, by brazing or by attachment to an intermediate annular plate secured to vessel 12. The fluid-tight seal can be achieved by an O-ring seal interposed between plate 15 and vessel 12 in a recessed channel or simply by the brazing of the plate to vessel 12.

The interior of cylindrical vessel 12 is divided into three adjacent chambers 24, 26 and 28. Chamber 24 is formed adjacent to end wall 14 for creating vibrationally excited neutral molecules. Molecules in the form of a gas are injected into chamber 24 through a port 18 in wall 14 using a pulsed gas valve 20 actuated to release gas from a gas source, not shown.

The gas injected is preferably hydrogen, deuterium or tritium, as these elements are the primary fuel sources used in plasma confinement and fusion research. The ion source need not be limited to these elements and elements such as boron, lithium and helium may be used, as future fusion reactors may demand, with adjustments to power supply outputs as would be apparent to those skilled in the art. Reference will be made to hydrogen for purposes of illustration for this embodiment.

The gas source is preferably a pressurized container of high purity gas. Fusion reactors and plasma devices are designed with gas capturing and recycling systems for hydrogen, deuterium and tritium as part of fueling cycles. The output of such systems can be connected to port 18 via tubing (not shown) for recycling spent neutral atoms or molecules. Additionally, port 18 can be formed as a manifold system 19 in order to direct gas molecules to several portions of chamber 24 simultaneously.

A population of relatively high energy, 40–80 eV, electrons is created and maintained in chamber 24 by an electron discharge means 30, with 80 eV being preferred. Discharge means 30 is any suitable filamentary structure operated at a high voltage by a power source. This can be accomplished for example by a plurality of water-cooled tungsten filaments 32, such as those illustrated in U.S. Pat. No. 4,140,940 to K. W. Ehlers which serve as the cathode for emitting high energy, 80 eV electrons and using the walls of vessel 12 as the anode. To accomplish this a discharge power source 36 has its negative terminal connected to each of the filament assemblies 32 and its positive terminal connected to vessel 12. Vessel 12 and end walls 14 and 16 are preferably made of an electrically conductive material, but a conductive lining of copper or other suitable material can be employed to assure proper operation of discharge means 30. Heaters for the tungsten filaments 32 are electrically connected to a power supply 34.

The electrons emitted by discharge means 30 interact with the neutral gas molecules in chamber 24 to increase their quantum vibrational energy states according to the equation:

$$H_2(V''=0)+e(\text{fast})\rightarrow H_2(V''\geqq 6)+e(\text{thermal}) \quad (1)$$

where V'' represents the current vibrational state of the molecule. The electrons and excited molecules also interact with vessel 12 walls in chamber 24 to produce an equilibrium population of neutral molecules, excited molecules, and electrons (fast and thermal) after some time according to:

$$H+H_2(V''\geqq 6)\rightarrow H_2(V''<6)+H \quad (2)$$

and $$H_2+e^-(\text{fast})\rightarrow H+H+e^-(\text{thermal}) \quad (3)$$

An optimum density of ions occurs for an electron density of around $2\times 10^{12}$–$3\times 10^{13}$ electrons/cm$^3$.

The excited molecules drift across chamber 24 and into a negative ionization chamber 26 which is formed in vessel 12 adjacent to excitation chamber 24, there being no wall or sealing means to inhibit the excited molecules.

A magnetic filter means 40 extends across vessel 12, substantially perpendicular to the longitudinal axis of the cylindrical vessel, separating chamber 24 from chamber 26. Filter means 40, vessel 12 and end wall 14 form the boundaries of excitation chamber 24.

Figure 2:
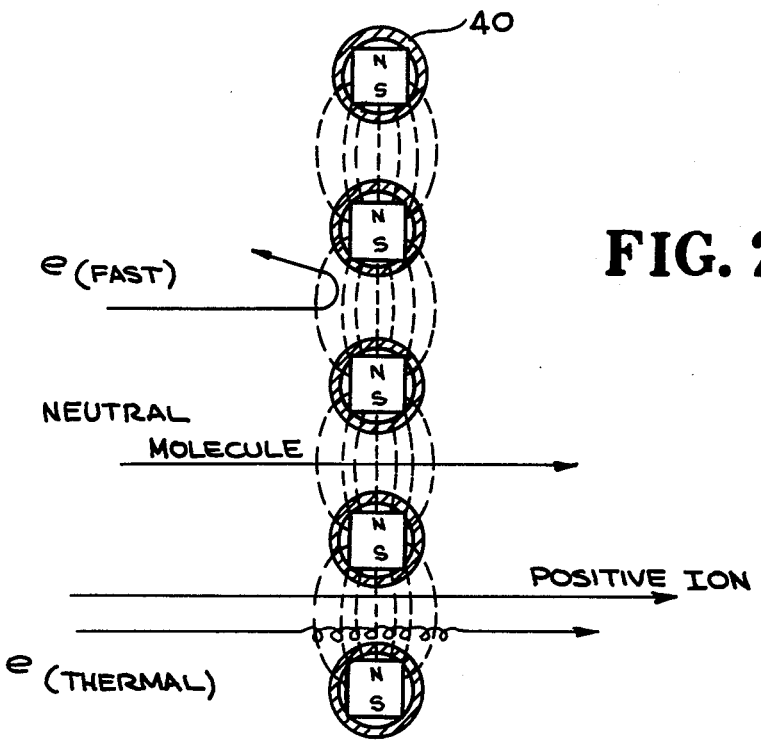
FIG. 2 is a schematic representation of particle interactions with a magnetic filter means.

Magnetic filter means 40 serves to reflect high energy electrons attempting to pass from chamber 24 to chamber 26. As shown in FIG. 2, a charged particle passing through filter means 40 has its trajectory curved by the magnetic field due to E×B forces. The amount of force, and thus the radius of curvature is dependent on the mass and velocity of the charged particle. The velocity of the high energy electrons, at their higher energy, is such that the magnetic field bends their trajectory in a small radial path. This deflects the electrons away from filter means 40.

Larger mass positive ions and neutral molecules penetrate filter means 40 as indicated in FIG. 2. Positive ions attract low energy thermal electrons and can drag them along when penetrating filter means 40. Therefore, some quantity of slower (velocity) thermal electrons will tend to penetrate across the filter. No deflecting force, however, is exerted on the neutral molecules by the magnetic field, and they pass through it freely.

Figure 3:
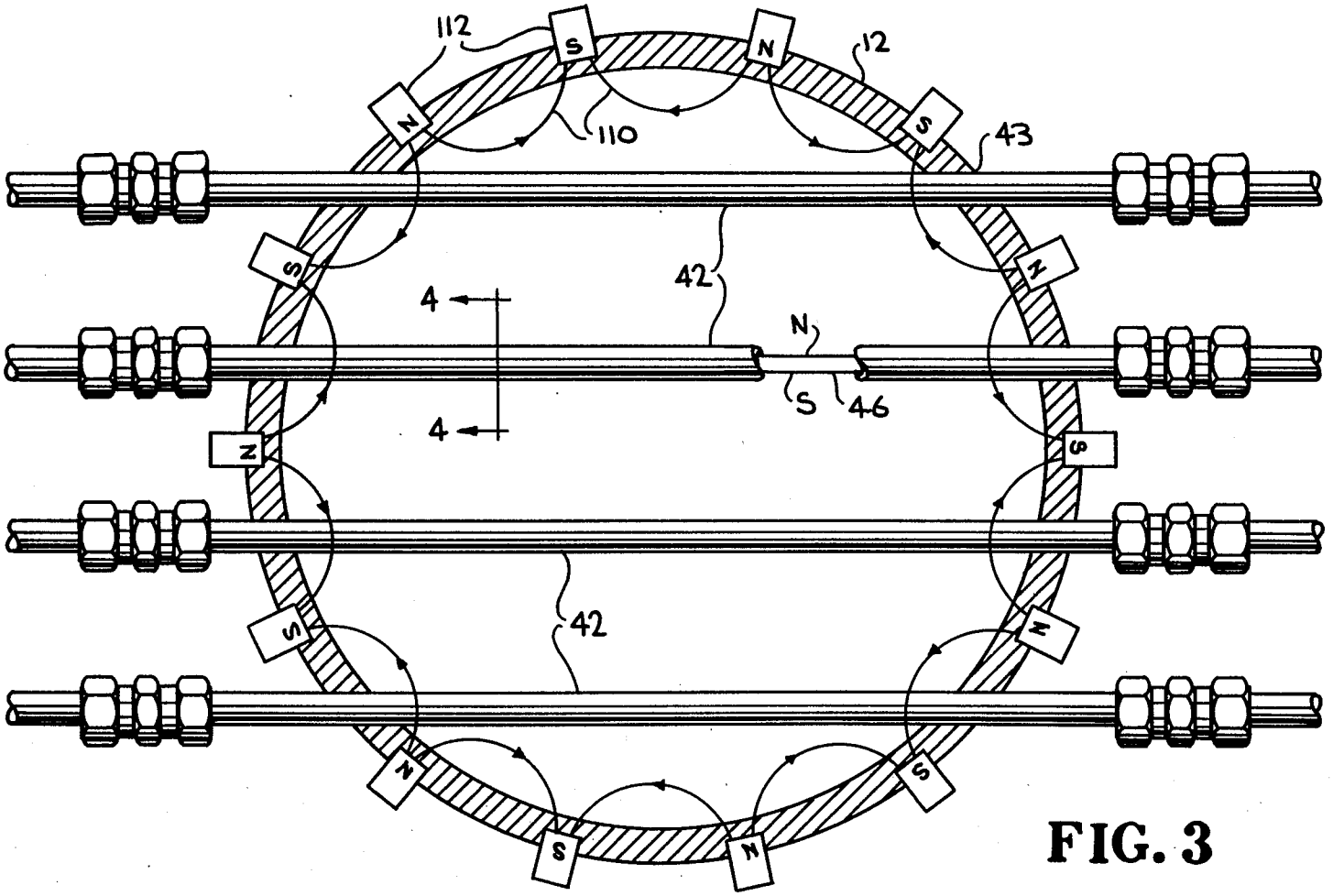
FIG. 3 is a cross-sectional view of the ion source of FIG. 1 along 3—3, showing an embodiment of a magnetic filter.
Figure 4:
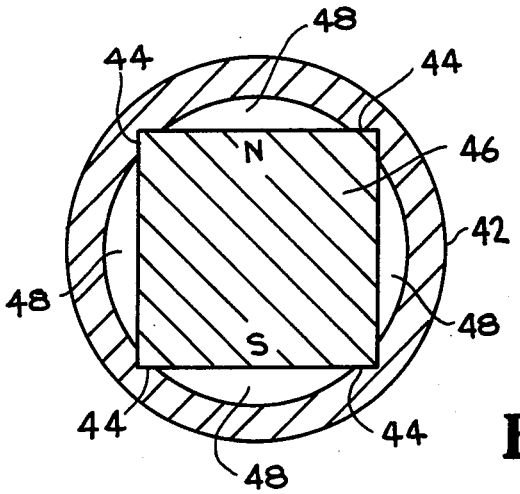
FIG. 4 is a cross-sectional view of FIG. 3 along 4—4, showing a portion of a permanent magnet and a tube for positioning and cooling the magnet in a magnetic filter.

A preferred embodiment of magnetic filter means 40 is illustrated in FIGS. 3 and 4. A plurality of parallel hollow tubes 42 are positioned to extend across the interior of the vessel 12. The tubes, like vessel 12 and end wall 14, are made from or covered by an electrically conductive material, in order to maintain the proper electrical potential when vessel 12 is an anode for discharge means 30. It is also desired to have the tubes made from a highly heat conductive material for cooling. Copper is preferred for these reasons although other materials would be apparent to one skilled in the art.

As shown in FIG. 3, tubes 42 extend through apertures 43 in the cylindrical wall of vessel 12. The tubes may be secured in place by brazing, soldering, or special adhesives, with brazing being preferred. The interface between vessel 12 and tubes 42 must be fluid-tight in order to prevent other particles or gases from entering the vessel and contaminating the neutral beam. As shown in FIG. 4, the interior walls of tubes 42 are broached to provide a series of equally-spaced, longitudinally extending grooves 44 for receiving and fixing in place a number of permanent magnets 46.

Magnets 46 provide the magnetic fields of filter means 40. The magnets can be any permanent magnetic material with high field samarium/cobalt being preferred for this application. The magnets 46 are each several centimeters long and are arranged in series within tubes 42 immediately adjacent to each other in order to establish a continuous, substantially uniform magnetic field. The north and south poles of the magnets 46 in a given tube 42 are aligned to face the same direction as shown in FIG. 4. The permanent magnets have square cross-sections with corners for engaging grooves 44 and leaving longitudinally extensive cooling channels 48 adjacent to each side of each permanent magnet 46. Tubes 42 can have square or other regular geometric shapes to their cross-section, as well as the circular embodiment illustrated in FIGS. 3 and 4.

Tubes 42 and magnets 46 are heated by radiative processes from electron discharges in vessel 12 and energetic particles (molecules or electrons) that strike the tube surfaces. Tubes 42 are made with a small diameter, on the order of several millimeters, to reduce their cross-section for intercepting energetic particles A cooling fluid, such as but not limited to water, is pumped through channels 48 in order to cool the magnets and dissipate heat deposited in the magnetic filter means 40 structure. The fluid can be provided by a variety of cooling systems known in the art.

Figure 5:
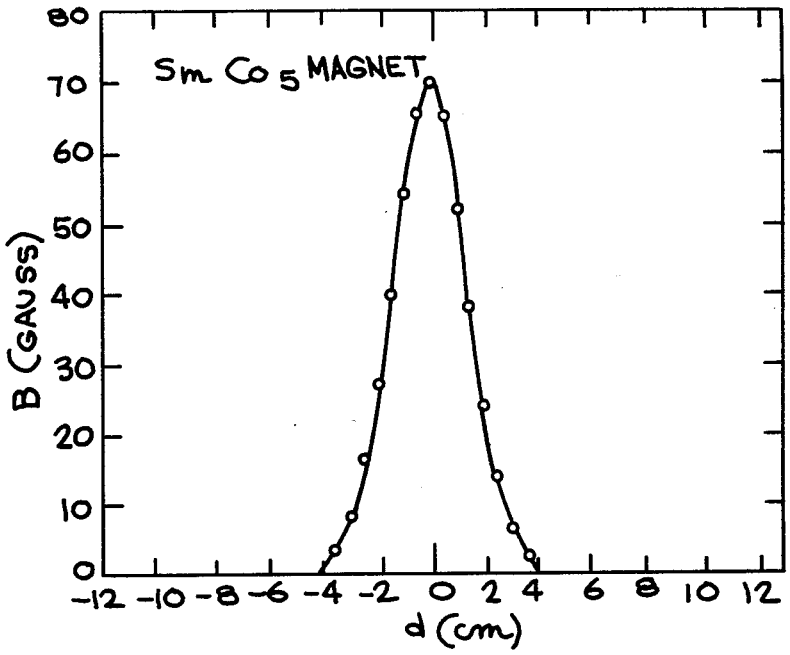
FIG. 5 is a graphic representation of magnetic field strength versus distance from a magnetic filter for one embodiment of the invention.

The permanent magnets 46 in each of the tubes 42 provide a magnetic field on the order of 180 gauss-cm between adjacent tubes. Tubes 42 are positioned across vessel 12 so that the north magnetic poles of one tube 42 faces the south magnetic poles of the next or adjacent tube 42 as shown in FIG. 3. FIG. 5 shows a plot of the magnetic field B, for 75 gauss magnets, as a function of distance away from the tubes 42 of the magnetic filter assemblies. The magnetic field strength of magnets 46 is chosen to be stronger than would be required for a positive ion source. In a positive ion source electrons are partially repelled by negative extractor potentials whereas the magnetic field performs the whole function here. The force required to deflect the electrons determines the spacing of tubes 42 in magnetic filter means 40 (along with tube size). For a tube 42 diameter of about 6 millimeters and magnetic field of 180 gauss-cm (for magnets 46) the separation between tubes is about 4 centimeters.

In chamber 26 a population of low energy (thermal) electrons on the order of 1 eV are created by an electron discharge means 50. Discharge means 50 is any suitable filamentary structure operated at a high voltage by a power source with an associated anode. This discharge can be accomplished, as with discharge means 30, by a plurality of water-cooled tungsten filament assemblies 52 serving as cathodes and the walls of the vessel 12 serving as the anode for the discharge. Heaters for filaments 52 are connected to power supply 54, and a discharge power source 56 has its negative terminal connected to filaments 52 and its positive terminal connected to vessel 12.

The low energy electrons created by discharge means 50 interact with the excited hydrogen molecules in chamber 26 and dissociate them into negative ions according to:

$$e^-(\text{thermal})+H_2(V''\geqq 6)\rightarrow H^-+H \quad (4)$$

Even thermal electrons crossing through magnetic filter means 40, from chamber 24, will accomplish the same reaction. The mode of operation for chambers 24 and 26 does not, therefore, require the magnetic filter means to prevent thermal electrons from passing through as these electrons cannot ionize $H_2$ molecules or H atoms to make $H^+$, but assist in the formation of $H^-$ ions. The ions formed by dissociation in chamber 26 are accelerated into an extraction chamber 28 using a potential grid 90 formed in end wall 16 of vessel 12 at the end of chamber 28.

A magnetic filter means 60 extends across vessel 12, substantially perpendicular to the longitudinal axis of the cylindrical vessel, separating chamber 26 from chamber 28. Vessel 12, magnetic filter means 40 and magnetic filter means 60 form the boundaries of chamber 26 while filter means 60, vessel 12 and end wall 16 form the boundaries of extraction chamber 28.

Figure 7:
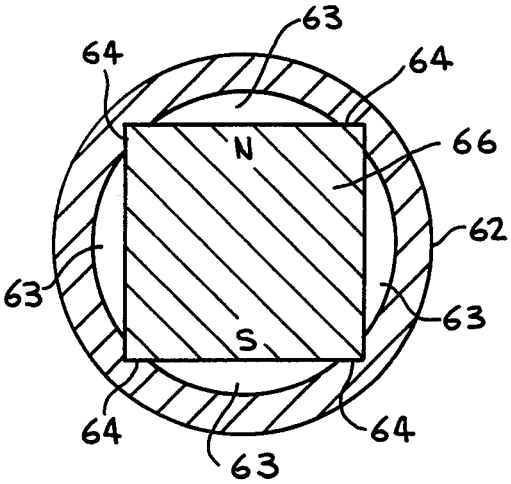
FIG. 7 is a cross-sectional view of FIG. 6 along 7—7, showing a portion of a permanent magnet and a tube for positioning and cooling the magnet in a magnetic filter.
Figure 6:
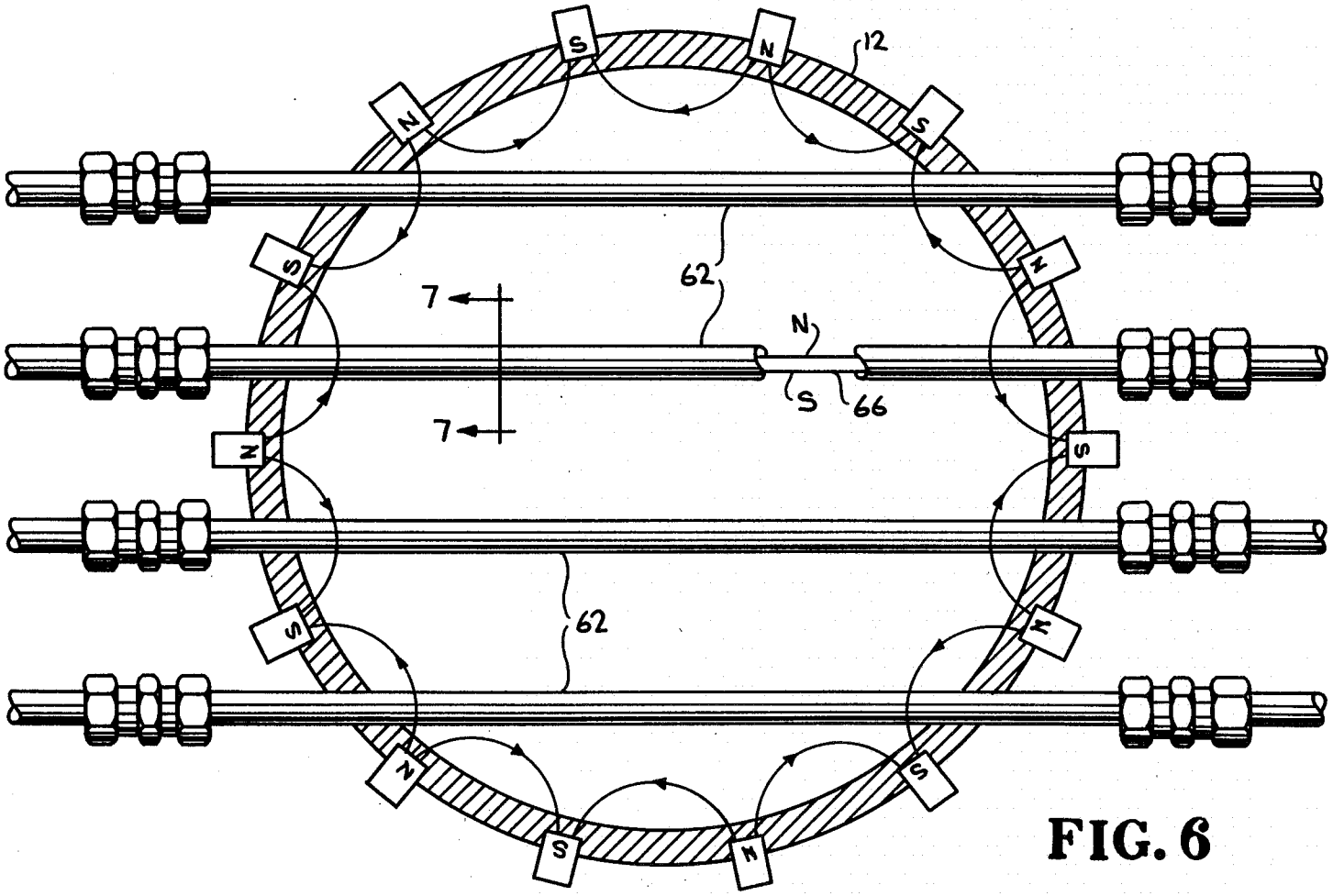
FIG. 6 is a cross-sectional view of the ion source of FIG. 1 along 6—6, showing an embodiment of a magnetic filter.

Magnetic filter means 60 serves to reflect high energy electrons attempting to pass from chamber 26 to chamber 28. Magnetic filter means 60 is constructed in the same manner as filter means 40, as shown in FIGS. 6 and 7, with permanent magnets secured inside tubes 62 which extend across vessel 12. Filter means 40 and filter means 60 may differ in the spacing between tubes 42 and 62, respectively. The spacing between tubes 62 for a 50 $mA/cm^2$ output is on the order of about 6 cm.

The mean free path for ion-ion collisions for the ions formed in chamber 26 predetermines the spacing of tubes 62, whereas high energy electron deflection determines the spacing of tubes 42. The ion-ion mean free path determines how long ions exist before interactions can neutralize them again or create positive ions. A finer or closer spacing of tubes 62 in filter means 60 helps reduce ion-ion collisions as they traverse filter means 60 into chamber 28 since ion trajectories will be deflected slightly.

Figure 10:
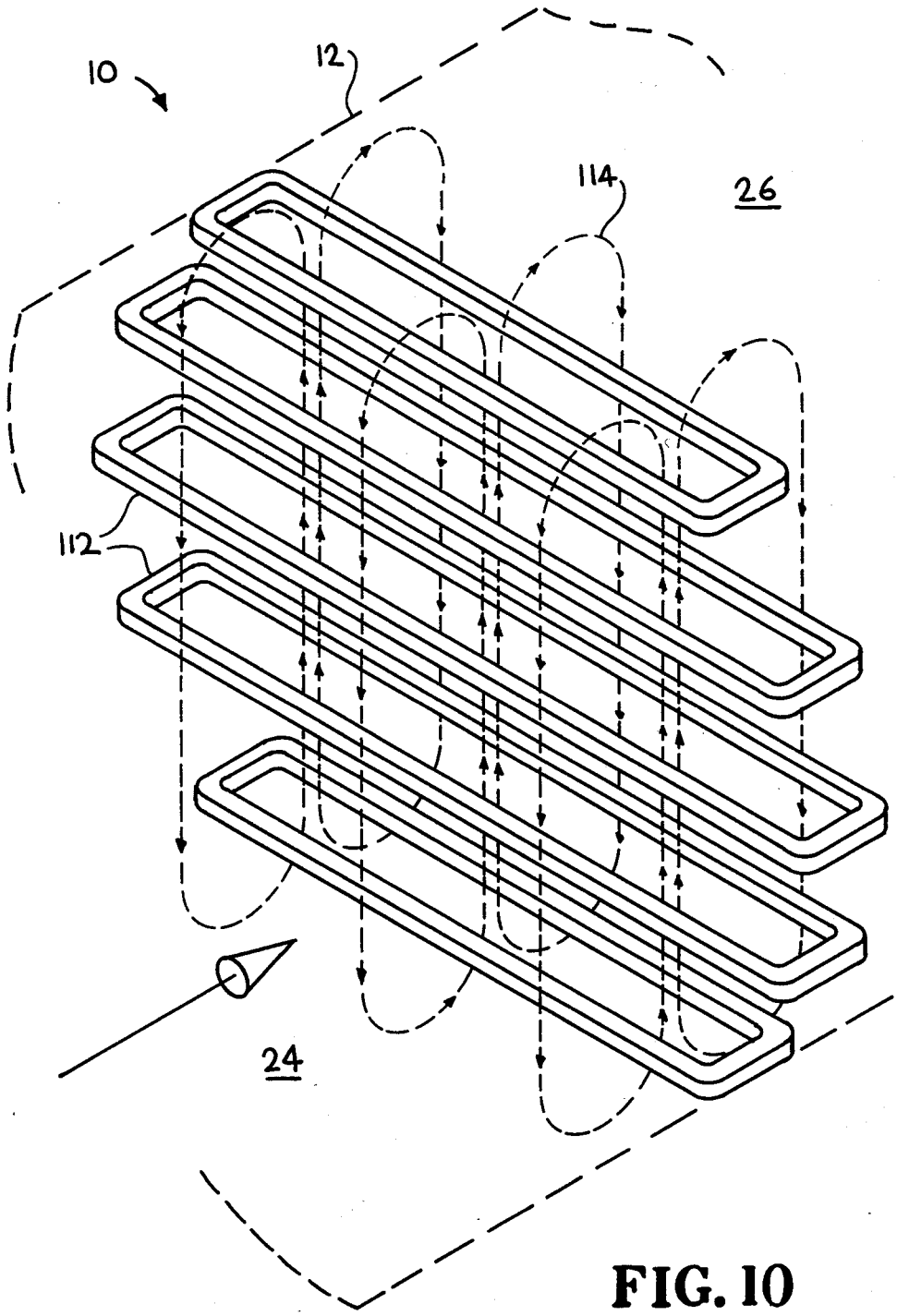
FIG. 10 is a perspective top and side view of an array of electromagnetic coils used for a magnetic filter means for the ion source of FIG. 1.

An alternative embodiment of filter means 40 or 60 replaces the array of magnets 46 or magnets 62, respectively, with a series of electromagnetic coils 112. This embodiment is better employed where vessel 12 has a square cross-section. As shown in FIG. 10, electromagnetic coils 112 are positioned across vessel 12 aong a common cylindrical axis and aligned so that magnetic fields from adjacent coils form a continuous, substantially uniform field as indicated by magnetic field lines 114. The coils are powered by an electrical power source (not shown) and provided with the required fluid cooling to dissipate heat as previously discussed.

Figure 8:
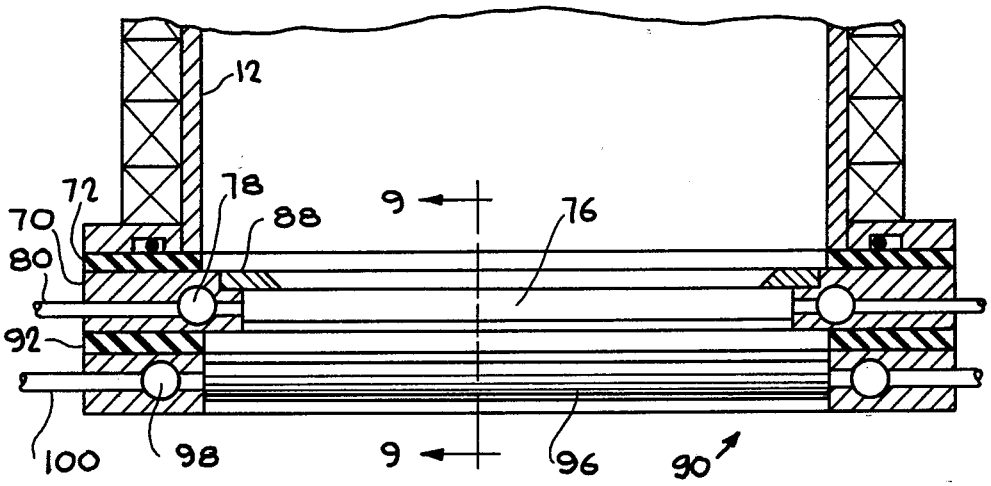
FIG. 8 is a cross-sectional view of an end wall of the ion source of FIG. 1 along 8—8, showing a masking plate, plasma grid and an extractor grid.

End wall 16 acts as an ion extractor, exit port and beam shaper for negative ion source 10. To achieve these results, as shown in FIG. 8, end wall 16 comprises a plasma grid 70, masking means 88 and extraction grid 90.

Plasma grid 70, as shown in FIG. 1, carries a positive electrical potential and forms a termination point for electrical fields and potentials of the plasma discharges created in chambers 24 and 26. Grid 70 is electrically insulated from vessel 12 by isolation means 72, which can be a ceramic spacer or other insulating material. The electrostatic potential of the grid is maintained by connecting a power supply 74 between vessel 12 and grid 70. Alternatively, a positive potential on grid 70 can be maintained with respect to vessel 12 by connecting power supply 74 between grid 70 and ground and adjusting the output.

Plasma grid 70 includes a plurality of parallel conductive grid members 76 made in the form of tubes in order to facilitate fluid cooling since the grid members will be subjected to some ion and electron bombardment from chamber 28. As illustrated in FIG. 8, the tubes are connected in parallel as, for example, through a manifold 78 which is then connected through port 80 to a fluid cooling system (not shown).

The plasma potential of chamber 28 with a zero bias voltage applied to grid 70 is more negative than the plasma potential of chamber 26 because of the increased negative ion concentration in chamber 28. The potential gradient formed by the potential in chamber 26 and more negative potential in chamber 28, would decrease the efficiency of ion source 10. The potential gradient tends to drive positive ions from chamber 26 into chamber 28, bringing low energy electrons with them. At the same time the gradient inhibits passage of negative ions from chamber 26 to chamber 28, and some negative ions may be accelerated back into negative ionizing chamber 26.

As the bias voltage on plasma grid 70 is made slightly positive, the grid compensates for the space charge of the negative ions and the difference in plasma potential between chambers 26 and 28 decreases. As a result, fewer positive ions, and associated low energy electrons, enter extraction chamber 28. In addition, more negative ions are extracted because they cross magnetic filter means 60 more easily and are not accelerated back into ionization chamber 26. Therefore, plasma grid 70 is biased more positive than vessel 12, on the order of 1 to 12 volts. Experiments have shown that increasing the bias voltage from power supply 74 beyond about four volts results in a decrease in negative ion current extracted.

As previously discussed, magnetic filter means 60 will inhibit passage of high energy electrons but does not prevent low energy electrons from passing into extraction chamber 28. These latter electrons in the extraction chamber 28 are drawn into the negative ion source 10 output flux which, as mentioned previously, creates a serious power drain and generates x-rays in the accelerating system.

Figure 9A:
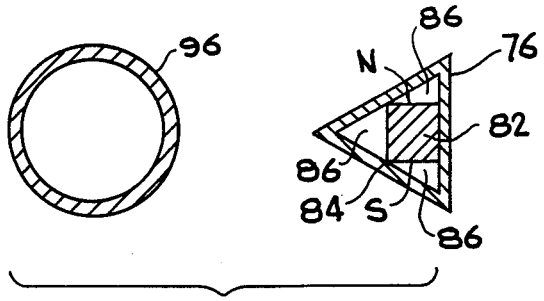
FIG. 9(*a*) is a sectional view of a plasma grid element of FIG. 8 having a permanent magnet positioned therein.
Figure 9B:
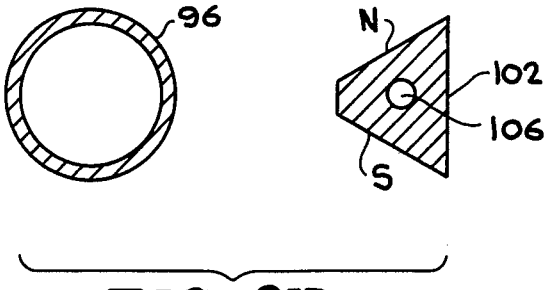

As an adjunct to eliminating electrons from the output beam of negative ion source 10 an array of permanent magnets 82 can be employed in the structure of plasma grid 70. FIG. 9A shows a cross-section view of one plasma grid member 76 shaped as a hollow triangular tube with a permanent magnet 82 positioned therein. The magnets have square cross-sections with corners for engaging grooves 84 and forming cooling channels 86 between the faces of the magnets and the interior surfaces of grid members 76. In this embodiment ceramic magnets are preferred, but it will be apparent to those skilled in the art that other types may be employed. An alternative method of providing a magnetic field across plasma grid 70 is illustrated in FIG. 9B. A plasma grid member 102 is made from conductive Alnico 4 material having a cooling passage 106 formed therein and is then permanently magnetized.

The grid members 76 are preferably triangular due to the effects of the magnetic fields. By narrowing the shape of the grid members 76, the magnetic field decreases rapidly toward extractor grid 90. In addition, the grid members narrow as space charge is trying to expand the beam of extracted ions. In either case this shape decreases contact with ions and deflections in trajectories as soon as the ions pass the grid.

The maximum magnetic field provided by ceramic magnets 82 is on the order of 350 gauss, falling off rapidly within 0.5 centimeters. For an extraction voltage of 1000 volts, an electron reaching plasma grid 70 will acquire an energy of 500 eV. The magnetic field of ceramic magnets 82 will cause ExB drift of these 500 eV electrons away from the extractor. The much heavier negative hydrogen ions will pass through with little effect.

Aperture plate 88, shown in FIGS. 1 and 8, is located adjacent to extraction grid 70 and controls the cross-sectional area of the ion output beam from ion source 10. Aperture plate 88 prevents ions having divergent trajectories that are substantially non-parallel to the longitudinal axis of vessel 12 from exiting with the beam and helps form a less divergent beam. Aperture plate 88 and plasma grid 70 are electrically connected together either by direct surface contact or by an electrical conductor of some kind. Aperture plate 88, as illustrated in FIG. 8, is brazed onto the plasma grid 70 structure. It will be apparent to one skilled in the art that aperture plate 88 could also comprise a separate annular plate secured parallel to plasma grid 70.

The extraction grid 90 carries an electrostatic charge for attracting ions in chamber 26 and accelerating ions in chamber 28. Grid 90 is electrically insulated from vessel 12 and the other components of end wall 16 by isolation means 92 which can be a ceramic spacer or other insulating material. The electrostatic potential of the grid is maintained by a power supply 94. In order to extract negative ions from chambers 26 and 28 the extractor grid 90 is biased positively with respect to vessel 12, and the grid potential can range from one to ten thousand volts depending on the energy required in the output beam. In the embodiment of the invention, as illustrated in FIG. 1, the positive bias is obtained by grounding extractor grid 90 and applying a large negative voltage between vessel 12 and ground, using voltage supply 94. As will be apparent to those skilled in the art, it is only necessary to maintain a positive potential on grid 90 with respect to vessel 12 and, therefore, the positive output of power supply 94 can be electrically connected between grid 90 and ground and the output voltage can be adjusted. Additional accelerator stages (not shown) can then accelerate the negative ions extracted from the ion source to higher potentials on the order of one megavolt.

Extractor grid 90 includes a plurality of parallel conductive grid members 96. Extraction grid members 96 are made in the form of tubes to facilitate fluid cooling since the grid members will be subjected to some ion and electron bombardment from chamber 28. As illustrated in FIG. 8, the tubes are connected in parallel, for example through a manifold 98 which is then connected through port 100 to a fluid cooling system (not shown).

In order to improve the particle dynamics and reduce ion and electron interactions with the walls of vessel 12 a multi-cusped magnetic field 110 may be used. To implement this field, illustrated in FIG. 3, a plurality of spaced apart samarium/cobalt permanent magnets 112 having a field strength on the order of 3.6 kilogauss are fixed into grooves on the outside of vessel 12 and end wall 14, as shown in FIGS. 1 and 3. The magnets are arranged so that the magnetic poles alternate, providing a multi-cusped magnetic field within vessel 12.

The foregoing description of a preferred embodiment of the invention has been presented for purposes of illustration and description. It is not intended to be exhaustive nor to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the inventon be defined by the claims appended hereto and their equivalents.

We claim:

1. A negative ion source comprising:

a vessel;

first and second magnetic filter means extending across said vessel dividing said vessel into an excitation chamber for creating vibrationally excited molecules and a negative ionization chamber for ionizing said excited molecules and an extraction chamber for extracting negative ions from said negative ionization chamber;

input means in fluid communication with said excitation chamber of said vessel for introducing neutral molecules into said excitation chamber;

a first discharge means operatively connected to said excitation chamber for emitting electrons of sufficient energy for vibrationally exciting said neutral molecules;

a second discharge means operatively connected to said negative ionization chamber for emittng ionizing electrons for ionizing said vibrationally excited neutral molecules;

extractor means coupled to said extraction chamber producing a positive electric field for extracting negative ions from said excitation chamber; and at least one plasma grid positioned adjacent to said extraction chamber being biased positive with respect to the plasma formed by said first and second discharge means.

2. The negative ion source of claim 1 wherein said first or second magnetic filter means comprises means for producing magnetic field lines substantially perpendicular to a line formed by said excitation, ionization and extraction chambers.

3. The negative ion source of claim 2 wherein said means for producing magnetic fields comprises:

a plurality of heat conductive and electrically conductive tubes having a substantially circular cross section traversing from one side of said vessel to an opposite side thereof and being parallel to each other;

a plurality of permanent magnets secured within the interior of said tubes having the north and south poles of adjacent magnets facing the same direction within each individual tube and having the north and south magnetic poles facing each other for adjacent tubes; and passages parallel to said magnets within said tubes for fluid coolant.

4. A negative ion source as recited in claim 3, wherein said permanent magnets are of the cobalt type.

5. A negative ion source as recited in claim 3 wherein said permanent magnets have a magnetic field strength on the order of 3.6 KiloGauss.

6. The negative ion source as recited in claim 2 wherein said means for producing field lines comprises: a plurality of fluid cooled electromagnetic coils positioned within said vessel with their cylindrical axis being coextensive and substantially perpendicular to the line formed by said excitation, negative ionization and extraction chambers.

7. The negative ion source of claim 1 including a plurality of permanent magnets positioned around the exterior of said vessel so as to form multi-cusped magnetic fields within said chambers.

8. The negative ion source of claim 1 wherein said first discharge means is operated so as to produce electrons having energy in the range of about 40 to 80 eV.

9. The negative ion source of claim 1 wherein said second discharge means is operated so as to produce electrons having particle energies on the order of 1 eV.

10. The negative ion source of claim 1 wherein said neutral molecules are composed of atoms from the group of atoms whose members are hydrogen, deuterium and tritium.

11. The negative ion source of claim 1 wherein a wall of said vessel forms the anode for the electron discharge of said first or second discharge means.

12. A negative ion source for ionizing neutral molecules as recited in claim 1, further comprising means for diverting electrons from the flow of negative ions positioned adjacent to said plasma grid.

13. The ion source of claim 12 wherein said means for diverting electrons includes means for providing a drift magnetic field aligned relative to the positive electric field of said extractor means so as to provide $E \times B$ drift to the electrons.

14. The ion source of claim 13 wherein the means for providing a magnetic field includes permanent magnets located adjacent to said extractor means.

15. A method of providing a large fluence of high energy negative ions without positive ions and reducing undesired electrons from a negative ion source output flux, comprising the steps of:

dividing a vessel into first, second and third tandem chambers using first and second magnetic filter means;

introducing a molecular gas into said first chamber of said vessel;

exciting said molecules to a state of high vibrational energy;

deflecting high-energy electrons with said first magnetic filter to prevent those electrons from entering said second chamber;

ionizing said excited molecules which pass into said second chamber;

transferring ions to the third chamber of said vessel by applied electric fields;

deflecting high-energy electrons with the second magnetic filter to prevent electrons from entering said third chamber;

extracting negative ions from the third chamber.

16. A method of providing a large fluence of high energy negative ions as recited in claim 15 wherein the step of exciting said molecules comprises the steps:

providing an electron discharge in said first chamber with a plurality of electrodes;

creating and maintaining a population of electrons having an energy level of about 80 eV with said electron discharge.

17. A method of providing a large fluence of high energy negative ions as recited in claim 15 wherein the step of ionizing said molecules comprises the steps:

providing an electron discharge in said second chamber with a plurality electrodes;

creating a population of electrons having an energy level of substantially 1 eV with said electron discharge.

18. A method of providing a large fluence of high energy negative ions as recited in claim 15 wherein the step of extracting said negative ions comprises the steps:

providing an extractor grid comprising fluid cooled tubular members;

maintaining a positive voltage on said grid in the range of about one thousand to ten thousand volts.

19. A method of providing a large fluence of high energy negative ions without positive ions and reducing undesired electrons from a negative ion source output flux as recited in claim 15, further comprising the step of:

providing a positive bias to a plasma electrode located adjacent to the third chamber in order to inhibit positive ions and accompanying low-energy electrons from being present in the output flux.

20. A negative ion source comprising:

a vessel having two end walls spaced apart and at least one side wall extending between the first end wall and the second end wall;

first magnetic filter means spaced apart from the two end walls of the vessel and extending across the vessel;

second magnetic filter means, spaced apart from the two end walls of the vessel and from the first filter means and lying between the first filter means and the second end wall and extending across the vessel, for creating an excitation chamber lying between the first end wall and the first magnetic filter means to create vibrationally excited neutral molecules, for creating a negative ionization chamber lying between the first and second magnetic filter means to ionize the excited neutral molecules that issue from the excitation chamber into the negative ionization chamber, and for creating an extraction chamber lying between the second magnetic filter means and the second vessel end wall to extract negative ions that issue from the negative ionization chamber into the extraction chamber;

fluid input means in fluid communication with said excitation chamber of said vessel, for introducing neutral molecules of a predetermined species into said excitation chamber;

a first discharge means operatively connected to said excitation chamber for emitting electrons of sufficient energy for vibrationally exciting said neutral molecules;

a second discharge means operatively connected to said negative ionization chamber for emitting ionizing electrons for ionizing said vibrationally excited neutral molecules that issue from the excitation chamber into the negative ionization chamber;

extractor means coupled to said extraction chamber producing a positive electric field, for extracting negative ions from said excitation chamber; and at least one plasma grid positioned adjacent to said extraction chamber and being biased positive with respect to the plasma formed by said first and second discharge means.

* * * * *